US008523236B2

(12) United States Patent
Leary

(10) Patent No.: US 8,523,236 B2
(45) Date of Patent: Sep. 3, 2013

(54) MAGNETIC FIELD SURFACE IMAGE METHOD, KIT AND PRODUCT

(76) Inventor: Jenny Leary, Sausalito, CA (US)

( * ) Notice: Subject to any disclaimer, the term of this patent is extended or adjusted under 35 U.S.C. 154(b) by 338 days.

(21) Appl. No.: 13/022,583

(22) Filed: Feb. 7, 2011

(65) Prior Publication Data

US 2012/0201979 A1 Aug. 9, 2012

(51) Int. Cl.
*B42D 15/00* (2006.01)
*B44F 1/10* (2006.01)

(52) U.S. Cl.
USPC ..... 283/82; 283/901; 428/29

(58) Field of Classification Search
USPC ..... 283/82, 901; 428/29
See application file for complete search history.

(56) References Cited

U.S. PATENT DOCUMENTS

| | | | | |
|---|---|---|---|---|
| 3,938,263 | A | 2/1976 | Tate | |
| 4,899,037 | A * | 2/1990 | Marechal et al. | 283/82 |
| 4,925,215 | A * | 5/1990 | Klaiber | 283/82 |
| 5,192,611 | A | 3/1993 | Tomiyama et al. | |
| 5,364,689 | A | 11/1994 | Kashiwagi et al. | |
| 5,411,398 | A | 5/1995 | Nakanishi et al. | |
| 5,565,772 | A | 10/1996 | Jeffers | |
| 5,630,877 | A | 5/1997 | Kashiwagi et al. | |
| 5,975,581 | A * | 11/1999 | Nicolette et al. | 283/82 |
| 6,159,577 | A | 12/2000 | Pynenburg et al. | |
| 6,759,097 | B2 | 7/2004 | Phillips et al. | |
| 7,517,578 | B2 | 4/2009 | Raksha et al. | |
| 2006/0150854 | A1 | 7/2006 | Benninger et al. | |
| 2006/0152804 | A1 | 7/2006 | Bove | |
| 2007/0115337 | A1 | 5/2007 | Raksha et al. | |
| 2007/0251603 | A1 | 11/2007 | Olson | |
| 2008/0152902 | A1 | 6/2008 | Adler | |
| 2008/0289526 | A1 | 11/2008 | Bachman | |
| 2010/0040845 | A1 | 2/2010 | Schmid et al. | |

FOREIGN PATENT DOCUMENTS

| | | | |
|---|---|---|---|
| EP | 939388 | A2 | 9/1999 |
| GB | 2421204 | A | 6/2006 |
| JP | 2004148751 | A | 5/2004 |

* cited by examiner

*Primary Examiner* — Kyle Grabowski
(74) *Attorney, Agent, or Firm* — Intellectual Property Law Group LLP

(57) ABSTRACT

A method, kit and product for hidden surface images or designs utilizing reshaped magnetic fields. The magnetic field of a hidden surface image is manipulated and controlled to form a clearly defined shape revealed through a magnetic field viewing device. The method comprises forming a design/image element from a magnet; forming a corresponding housing layer opening replicating the shape of the element; reshaping the magnetic field of the element; placing the reshaped element into the housing layer; covering/securing the element beneath a masking layer; and viewing the element with a magnetic field viewing device. A kit for hidden magnetic surface imaging method comprises a magnetic medium, housing layer, adhesive, masking layer, and a strong magnet for reshaping the magnetic field. A hidden magnetic field surface image product comprises a housing layer including a defined opening, an image element comprising a flexible magnet housed within the opening and a masking layer.

7 Claims, 5 Drawing Sheets

MAGNETIC FIELD SURFACE IMAGE METHOD, KIT AND PRODUCT

BACKGROUND

1. Field of Invention

This invention relates to a magnetic field imaging technique, in particular, a method, kit and product for hidden surface images/designs utilizing magnetism. More particularly, the invention uses a magnetic viewing device to expose hidden surface images or designs formed by manipulating and controlling a magnetic field.

2. Background

A magnetic field, typically invisible to the naked eye, can be made visible by using magnetic viewing devices such as magnetic viewing film. Magnetic viewing film is used to expose a magnetic field's size and shape, allowing it to be seen. For example, the magnetic field of a magnet can be revealed by exposure to magnetic viewing film. An example of magnetic viewing film is sold under the trademark MAGNE-RITE. Such film has been known to be used for flaw detection in manufactured magnets and for identifying common magnetic field patterns. Unless a magnet has been carefully manipulated to control the shape of its magnetic field, the shape of the exposed magnetic field remains amorphous. Depending on how typical magnets are polarized, the revealed shape or image will indicate a pattern common to the polarization of the particular magnet. For example, the magnetic field of a flat magnet exposed by magnetic viewing film typically reveals striped parallel lines.

Attempts in the past to incorporate magnets into products result in adding iron powder to typical mediums in which to thereafter attach magnets. Such products include magnetic wallpaper or magnetic paint. The result is to have a medium receptive to attaching magnets. In other cases, particles in a surface are attracted using a magnet in order to create a visible shape. The entire shape is always modifiable or distorted as the magnetic source is moved across a surface. However, none of these existing products conceive of a magnetic field surface design or image technique which is hidden and only revealed through the use of a magnetic field viewing device. In other words, there is a need for a transiently visible magnetic image technique which can be incorporated into products to reveal a constant image or design.

The use of decorative patterns or designs as well images on surfaces has been desirable in various applications. It has been desirable to incorporate hidden images which can be exposed at will for special occasion decorative purposes or to use hidden images or words in game or educational products for example board games, toys, flashcards or in products where hidden images or messages are desired. Therefore, a need exists for hidden surface designs and images that can be subsequently exposed or revealed in a clearly defined form when not visible with the naked eye.

Accordingly, a need for a method or kit to form hidden surface designs/images utilizing magnetic fields where the magnetic field is manipulated to show solid defined shapes and designs exists.

SUMMARY

The present invention provides a method for creating hidden surface images and designs utilizing a magnetic field that has been manipulated to create specific shapes and designs. The terms design and image are used interchangeably throughout this document. This magnetic field imaging method utilizes a flexible magnetic sheet, a bar magnet, adhesive, a housing layer, a masking layer and a magnetic viewing device, such as magnetic viewing film or iron filings.

The shape of the hidden design is first created by forming or cutting out the design from the rubber magnet sheet, thereby resulting in the cutout design element. The exact shape of the design element is then cut from the housing layer. The housing layer is ideally the same thickness as the rubber magnet sheet. The design element is then re-magnetized using a bar magnet that is ideally stronger that the magnetism contained in the design cut out. The design element is re-magnetized such that any pre-existing magnetic pattern, such as parallel lines, is reshaped to form a magnetic field image showing a solid pattern.

After the design element is re-magnetized it is placed in corresponding cutout portion of the housing layer. The design element and the housing layer are adhered together with an adhesive. Here, the surfaces of the design element and the housing layer are ideally flush such that no seams are detectable.

Thereafter, a masking layer is place over the housing layer to mask the design element from view. The masked design element therefore comprises the hidden surface design which can be later revealed using magnetic viewing film. If the design element is not re-magnetized before placing in the corresponding cutout portion of the housing layer, it may be re-magnetized at that point after placed in the housing layer or after being covered by the masking layer.

There is further disclosed a kit that provides a rubber magnetic sheet, a bar magnet, adhesive, a housing layer, a masking layer and a magnetic viewing device, such as magnetic viewing film or iron filings, utilizing magnetism to create hidden surface designs.

There is further disclosed a product with a hidden surface design created from manipulating a magnetic field to form a design.

These and other aspects of the present invention are further made apparent, in the remainder of the present document, to those of ordinary skill in the art.

BRIEF DESCRIPTION OF THE DRAWINGS

In order to more fully describe embodiments of the present invention, reference is made to the accompanying drawings. These drawings are not to be considered limitations in the scope of the invention, but are merely illustrative.

DETAILED DESCRIPTION OF SPECIFIC EMBODIMENTS

The description above and below and the drawings of the present document focus on one or more currently preferred embodiments of the present invention and also describe some exemplary optional features and/or alternative embodiments. The description and drawings are for the purpose of illustration and not limitation. Those of ordinary skill in the art would recognize variations, modifications, and alternatives. Such variations, modifications, and alternatives are also within the scope of the present invention. Section titles are terse and are for convenience only.

Figure 1:
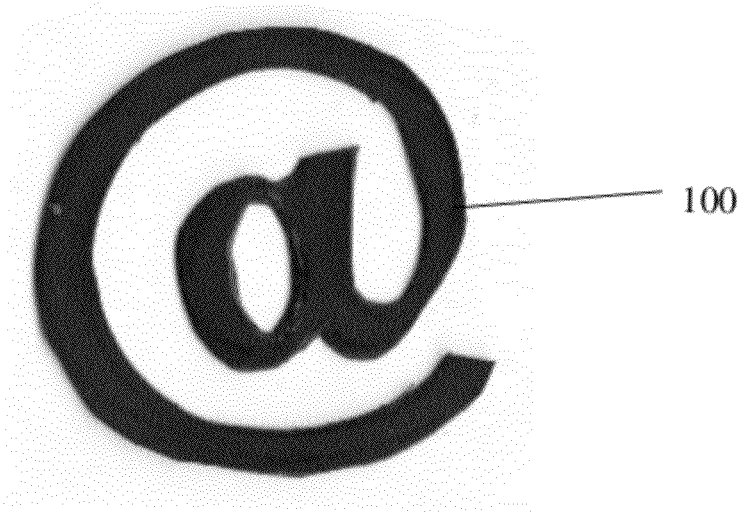
FIG. 1 shows a design element, according to an embodiment of the present invention.

Utilizing a magnetic field imaging method, a hidden surface design or image, shaped by controlling and manipulating a magnetic field is exposed using a magnetic device. The magnetic field imaging method begins with forming a design element or image element from a magnetic medium, such as a flexible magnet sheet, as shown in FIG. 1. The design element may be any shape, image, letters or words. The magnet sheet may be flexible. For example, the magnet sheet may be made of soft plastic/polymer containing ferrite powder and injected with magnetic fields after being passed under a magnetizer. The high ferrite content allows the magnet to retain a magnetic field when passed under the magnetizer. The design element can be formed by using scissors, a laser cutter, or any other cutting method as known in the art.

Figure 2:
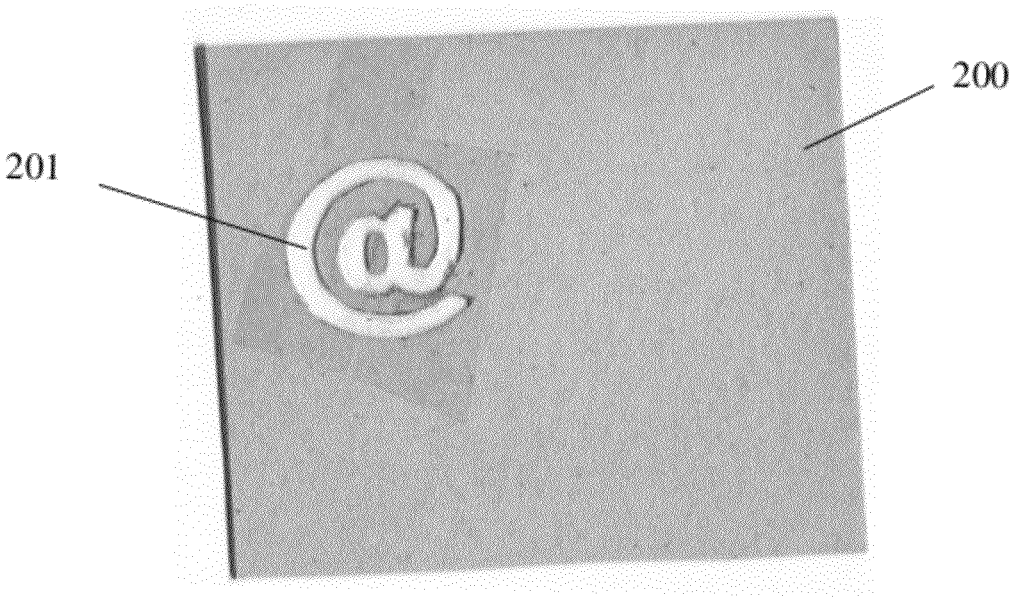
FIG. 2 shows a housing layer with an exact opening cutout for the design element of FIG. 1, in accordance with an embodiment of the present invention FIG. 3. shows the magnetic field of the design element of FIG. 1, as seen through a magnetic viewing film, according to an embodiment of the present invention.

After forming the design element FIG. 1, the exact shape of the design element 100 is cut from a housing layer 200. The replicated cutout opening 201 in the housing layer 200 is cut such that the design element fits precisely into the replicated cutout opening 201, as shown in FIG. 2. The housing layer 200 can be any material that blocks magnetism and prevents a magnetic field from passing through it. In an embodiment of the invention, the housing layer can be made of rigid material for example cardboard, a sheet material, or any other similar material known in the art. The thickness of the housing layer is preferably the same thickness as the rubber magnet sheet. In an embodiment the thickness may be 1 mm or less.

Figure 3:
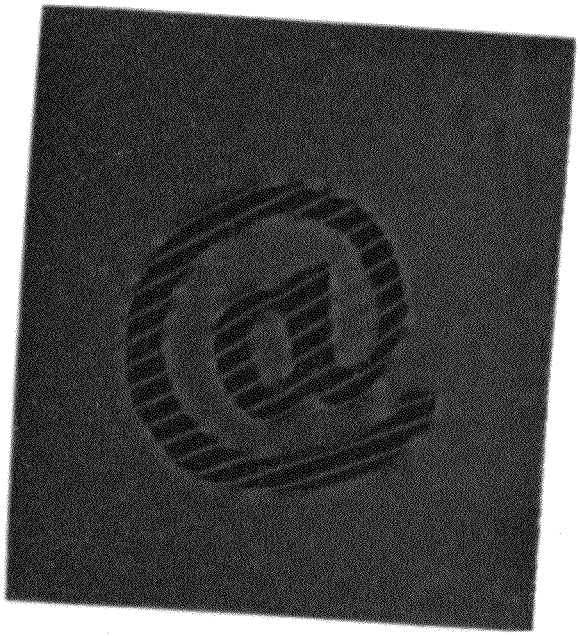
Figure 4:
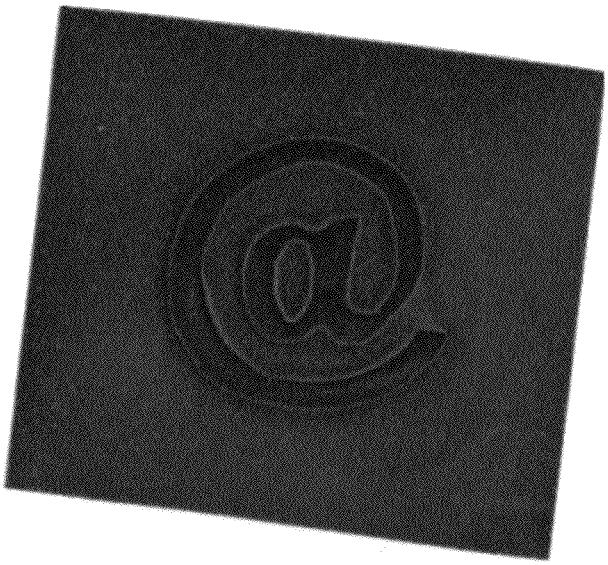
FIG. 4 shows the magnetic field of the re-magnetized design element of FIG. 1, as seen through a magnetic viewing film, according to an embodiment of the present invention.

The rubber magnet sheet of the design element may be manufactured and originally magnetized such that its magnetic field is shaped in parallel stripes, as shown in FIG. 3. In the present magnetic field imaging method, the magnetic field of the design element is reshaped and manipulated by re-magnetizing the design element with a stronger bar magnet. A neodymium magnet, or any other magnetic having a stronger magnetism may be used. In an embodiment of the invention, for example, re-magnetizing is achieved by rubbing the design element with a neodymium bar magnet such that the rubbing drags the magnetic moment in the design element, to its edges. By re-magnetizing the design element, the magnetic field is rearranged from the parallel stripes to gather at the edges of the design element to form a clearly defined image, as shown in FIG. 4.

Figure 5:
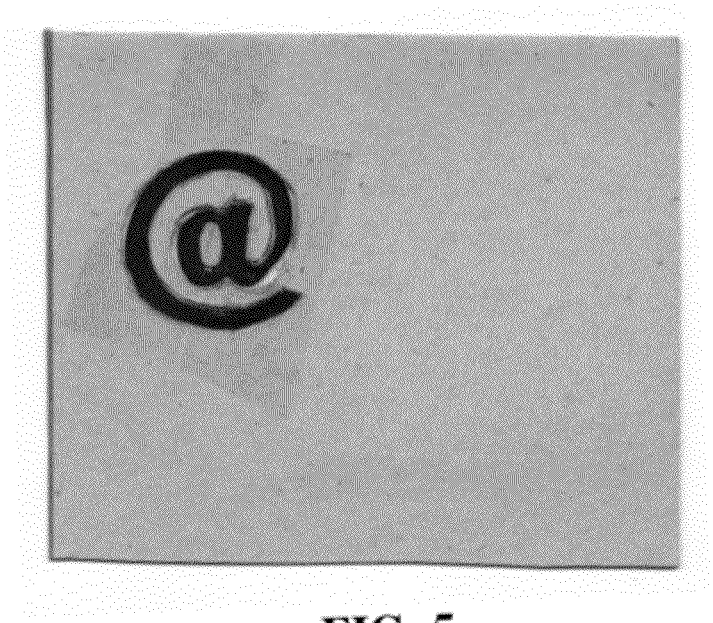
FIG. 5 shows the design element inserted into the housing layer of FIGS. 1 and 2, according to embodiment of the present invention.

After both the design element and the housing layer are cut, the design element is placed in the housing layer opening. An adhesive is used to adhere the design element and the housing layer together. For example, an adhesive tape can be used, as shown in FIG. 5. The surfaces of the design element and housing layer are ideally flush and undetectable by touch.

Figure 6:
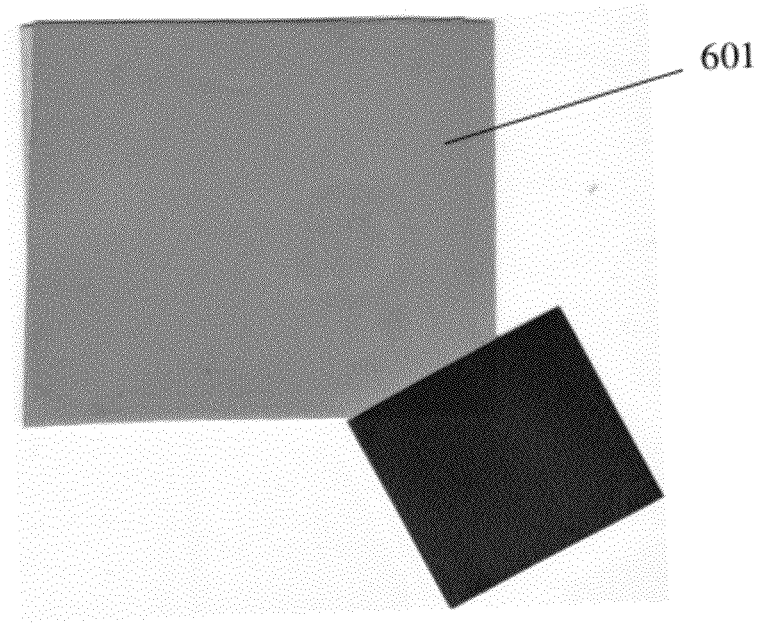
FIG. 6 shows a masking layer placed over the design element and housing layer of FIG. 5, according to an embodiment of the present invention.

A masking layer 601 is then placed over the housing layer such that the design element and the housing layer are hidden from view, as shown in FIG. 6. The masking layer 601 is thick or opaque enough to mask the design element from view, serving to hide the design element from sight and touch; but at the same time thin enough to allow viewing of the magnetic field of the design element. In one embodiment, the masking layer is a thin sheet of opaque paper of any color or pattern. In another embodiment, the masking layer of paper is attached to the housing layer and design element with a spray adhesive. With the masking layer placed over the housing layer, the design element is now hidden and can now form hidden surface designs/images.

The design element may be re-magnetized before placing in the corresponding cutout portion of the housing layer 200, or it may be re-magnetized at that point after being placed in the housing layer 200 or after being covered by the masking layer 601.

Figure 7:
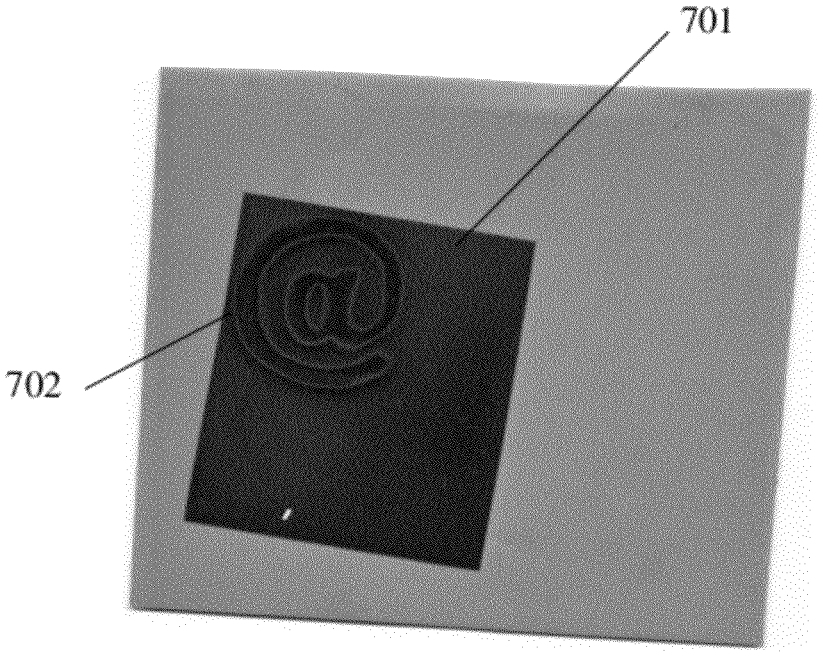
FIG. 7 shows magnetic viewing film placed over the hidden surface design of FIG. 6, according to an embodiment of the present invention.

The hidden surface design can then be exposed by placing a magnetic viewing device over the surface of the masking layer. In an embodiment of the invention, the magnetic viewing device may be magnetic viewing film. When the magnetic viewing film is placed over the hidden surface design 701, the re-magnetized magnetic field of the design element 702 will appear on the film, revealing the hidden surface design, as shown in FIG. 7.

Figure 8:
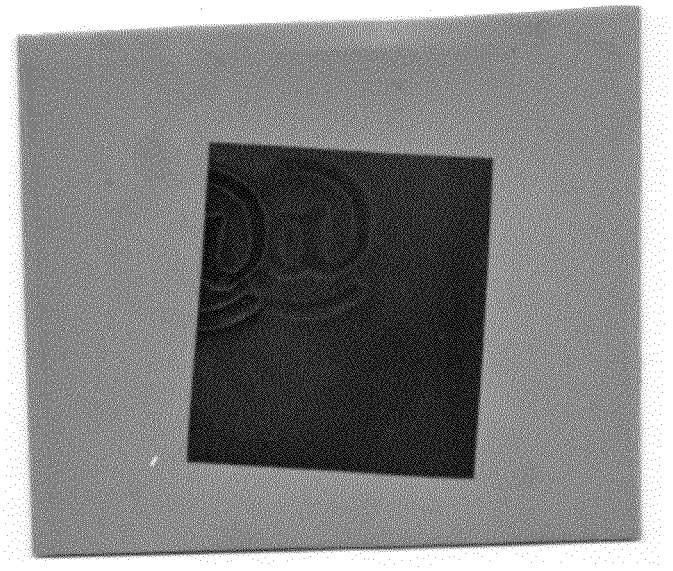
FIG. 8 illustrates the use of magnetic viewing film as it is used to view the hidden design and then shifted in position to reveal the design again.

In an embodiment of the invention, the magnetic viewing film may be moved or shifted from its initial placement over the hidden surface design to a different position. This will show a ghost image of the design element in the magnetic viewing film where the hidden surface designed was revealed and a duplication of the design on a different portion of the film, as show in FIG. 8. As the magnetic viewing film is removed from the hidden surface design, the design element remains visible in the film until the film is 'reprogrammed'. In one embodiment, for example, the design element is removed from the magnetic viewing film when the film is brought into contact with a magnetic field again.

In another embodiment of the present invention, the magnetic field imaging method utilizes a flexible magnetic sheet, a bar magnet, adhesive, a housing layer, a masking layer and a magnetic viewing device such as iron filings. In this embodiment, iron filings serve to reveal the hidden reshaped magnetic field design. Iron filings are sprinkled over the design, adhere to the magnetic field from the design element, form a shape and thus reveal the hidden surface design.

In an embodiment of the invention, a hidden surface design is created from the magnetic field imaging method through a kit comprised of at least, a rubber magnet sheet, a housing layer, adhesive, a masking layer, and a magnetic viewing device. By providing a rubber magnet sheet, a housing layer, adhesive, a masking layer and magnetic viewing device, a wide array of hidden surface designs can be created. In an embodiment of the invention, the rubber magnet sheet may be any magnetic medium that contains ferric powder, is capable of being cut or formed into a design and re-magnetized.

According to another embodiment of the invention, a hidden surface design product is created utilizing the magnetic field imaging method. A variety of products including any article of manufacture capable of having a surface design may incorporate the hidden surface design of the present invention. Example of products which may incorporate the hidden surface design technique of the present invention include but are not limited to, wallpaper, furniture surfaces, floorings, appliance and electronic surfaces, toy surfaces, game and educational applications, flash cards, testing materials, book covers, wearable apparel and accessories. The hidden image or design may be repeated in the underlying housing layer or subsequently changed by repeating the initial forming of the design/image element.

Figure 9:
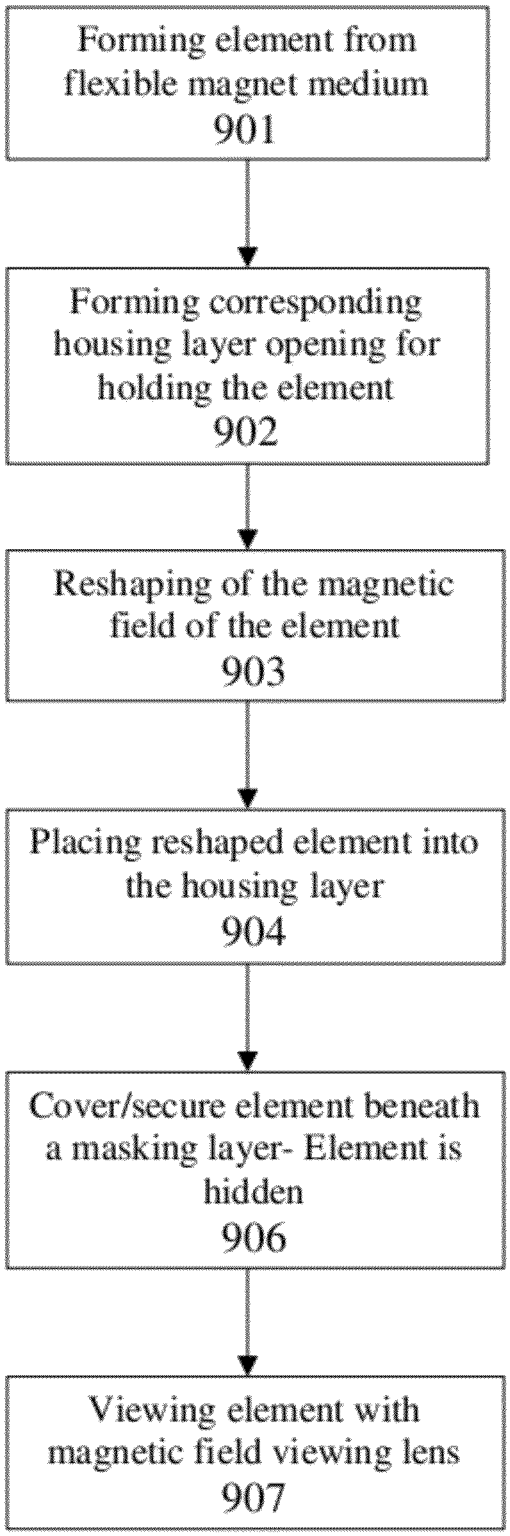
FIG. 9 illustrates the method of hidden surface imaging using a magnetic field according to an embodiment of the present invention.

FIG. 9 illustrates a flow diagram of an example method of hidden magnetic field surface imaging according to an embodiment of the present invention. The method may begin with forming the design/image element from a magnet medium 901; forming the corresponding housing layer opening for holding the element 902; reshaping the magnetic field of the element 903; placing the reshaped element into the housing layer 904; covering/securing the element beneath a masking layer 906; and viewing the element with magnetic field viewing device 907. In another embodiment of the present invention, reshaping the magnetic field of the element can occur at any step, so long as a bar magnet can be placed close enough to affect the re-magnetism of the magnet medium and the masking layer is thin enough to allow for it.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments or alternatives of the foregoing description.

I claim:

1. A method of surface design prepared from a kit comprising a rubber magnet sheet, a housing layer, an adhesive, a masking layer, and a magnetic viewing device, the method comprising the steps of:

forming a design cutout from the rubber magnet sheet;

re-magnetizing the design cutout using a bar magnet such that the magnetic field of the design cutout is reshaped and drawn out to edges of the design cutout;

cutting a corresponding shape of the design cutout from the housing layer and creating a replicated opening in the housing layer such that the design cutout fits precisely into the replicated opening;

adhering the design cutout to the replicated opening of the housing layer using the adhesive such that a surface of the design cutout and a surface of the housing layer are flush;

covering the housing layer and the design cutout by placing the masking layer over the surface of the housing layer such that the design cutout and the housing layer are hidden from view, the design cutout hereinafter referred to as the hidden surface design;

exposing the hidden surface design by placing the magnetic viewing device over the surface of the masking layer such that the re-magnetized magnetic field of the hidden surface design is displayed through the magnetic viewing device.

2. The method of claim 1, wherein the housing layer is comprised of a material that blocks magnetism.

3. The method of claim 1, wherein the housing layer is cardboard.

4. The method of claim 1, wherein the bar magnet in the step of re-magnetizing the design cutout, is a neodymium bar magnet capable of altering the magnetic field of the design cutout by rubbing the bar magnet directly along the surface of the design cutout to draw the magnetic field to the edges of the design cutout.

5. The method of claim 1, wherein the masking layer comprises a thin opaque sheet and wherein the magnetic viewing device is magnetic viewing film or iron filings.

6. The method of claim 1, wherein the step of forming a design cutout comprises cutting the magnet sheet with a laser cutter.

7. The method of claim 6, wherein the step of cutting the corresponding shape of the design cutout from the housing layer is completed with a laser cutter.

* * * * *